US011612785B1

(12) United States Patent
Schluger

(10) Patent No.: US 11,612,785 B1
(45) Date of Patent: Mar. 28, 2023

(54) THERAPY DEVICE AND METHOD FOR WRIST AND FOREARM

(71) Applicant: Zachary Schluger, Wyckoff, NJ (US)

(72) Inventor: Zachary Schluger, Wyckoff, NJ (US)

( * ) Notice: Subject to any disclaimer, the term of this patent is extended or adjusted under 35 U.S.C. 154(b) by 0 days.

(21) Appl. No.: 17/528,586

(22) Filed: Nov. 17, 2021

(51) Int. Cl.
*A63B 23/14* (2006.01)
*A63B 23/035* (2006.01)
*A63B 71/06* (2006.01)

(52) U.S. Cl.
CPC ..... *A63B 23/14* (2013.01); *A63B 23/03508* (2013.01); *A63B 71/0619* (2013.01); *A63B 2071/0694* (2013.01)

(58) Field of Classification Search
CPC ..... A63B 23/14; A63B 23/03508; A63B 71/0619; A63B 2071/0694; A63B 21/22; A63B 21/02; A63B 21/00; A63B 21/06; A63B 21/072
See application file for complete search history.

(56) References Cited

U.S. PATENT DOCUMENTS 4,378,113 A 3/1983 Piccini
5,364,325 A 11/1994 Matthews
5,674,162 A 10/1997 Ellingson et al.
5,676,622 A 10/1997 McFarlane
7,094,182 B1 8/2006 Holten
7,942,785 B1 5/2011 Russell
D694,348 S 11/2013 Rankin
10,058,725 B2 8/2018 LaCaze
2012/0309596 A1 12/2012 Kennedy et al.
2021/0353993 A1* 11/2021 Hamady ..... A63B 21/0608

FOREIGN PATENT DOCUMENTS

WO WO-2005065337 A2 * 7/2005 ..... A61B 8/0841

* cited by examiner

*Primary Examiner* — Andrew S Lo
*Assistant Examiner* — Jacqueline N L Loberiza
(74) *Attorney, Agent, or Firm* — Thomas J. Germinario

(57) ABSTRACT

The therapy device comprises a deflection tube and a handle, which are rotably disposed so as to be mutually perpendicular or parallel to one another. The deflection tube is made of transparent plastic or glass. It is semi-circular, closed on both ends, and filled with a transparent liquid that contains a freely floating bubble or ball, which acts as an indicator. When the handle is rotated, the indicator floats away from the center of the deflection tube toward one of its ends. The tube is marked at regular intervals with indicia, preferably numerals, which quantify the degree of deflection of the indicator toward an end of the tube, with higher numbers corresponding to greater deflection and hence greater rotation of the handle.

9 Claims, 5 Drawing Sheets

THERAPY DEVICE AND METHOD FOR WRIST AND FOREARM

FIELD OF INVENTION

The present invention relates to the general field of devices used in physical therapy, and more particularly to physical therapy devices designed to increase the range of motion of an injured or surgically repaired wrist or forearm.

BACKGROUND OF THE INVENTION

Wrist and forearm injuries commonly occur in sports, physical labor and everyday activities. Full recovery from such injuries often requires a period of rehabilitation which involves exercises to increase the range of motion of the injured body part. Such exercises can be conducted in the setting of supervised physical and occupational therapy, or independently by the injured party. To serve both therapy settings, there is a need for a device which is both inexpensive and simple to use. The present invention provides such a device and its method of use.

SUMMARY OF THE INVENTION

The basic components of the present invention are a handle and a deflection tube, which is rotatably attached to the handle so that the deflection tube can be oriented either perpendicular or parallel to the handle. The deflection tube is made of transparent plastic or glass. It is semi-circular, closed on both ends, and filled with a transparent liquid that contains a freely floating bubble or ball, which acts as an indicator. When the handle is rotated, the indicator floats away from the center of the deflection tube toward one of its ends. The tube is marked at regular intervals with indicia, preferably numerals, which quantify the degree of deflection of the indicator toward an end of the tube, with higher numbers corresponding to greater deflection and hence greater rotation of the handle.

Preferably, the indicator is designed to float slowly through the tube. The indicator takes between 0.5 seconds to 1.5 seconds to float between two numbers on the tube. This slow motion promotes controlled wrist and forearm rotation so that the user does not rush through the exercise. The user of the device is instructed to rotate their wrist/forearm at the same rate as the indicator ball until they feel a stretching sensation or resistance to motion in their wrist or forearm. They are then instructed to hold this stretched position for a minimum of six seconds, and repeat ten times. By holding the stretched position, this will help to elongate contracted soft tissue and muscles, which will then allow for increased range of motion. The other way of using this device is to rotate the wrist or forearm at a much faster rate than the indicator until the user feels a stretch, and then wait for the ball to "catch up." The slow speed of the indicator ball acts as a timer.

For wrist therapy, the deflection tube is oriented perpendicular to the handle. The device handle is gripped in the user's hand generally horizontally, with the ends of the deflection tube pointed obliquely sideways. The user then rotates his/her wrist alternately upward and downward, thereby correspondingly rotating the handle and with it the deflection tube. The angular rotation of the wrist is reflected in the deflection of the indicator bubble/ball within the tube, as measured by the numerical indicia. The objective of this exercise is to repeat the alternating wrist motions, known as extension (bending upward) and flexion (bending downward), so as to progressively increase the wrist's range of motion.

For forearm therapy, the deflection tube is oriented parallel to the handle. The device handle is gripped in the user's hand generally vertically, with the ends of the deflection tube pointed downward. The user then rotates his/her forearm alternately inward (palm turning downward) and outward (palm turning upward), thereby correspondingly rotating the handle and with it the deflection tube. The angular rotation of the forearm is reflected in the deflection of the indicator bubble/ball within the tube, as measured by the numerical indicia. The objective of this exercise is to repeat the alternating forearm motions, known as pronation (palm turning downward) and supination (palm turning upward), so as to progressively increase the forearm's range of motion.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
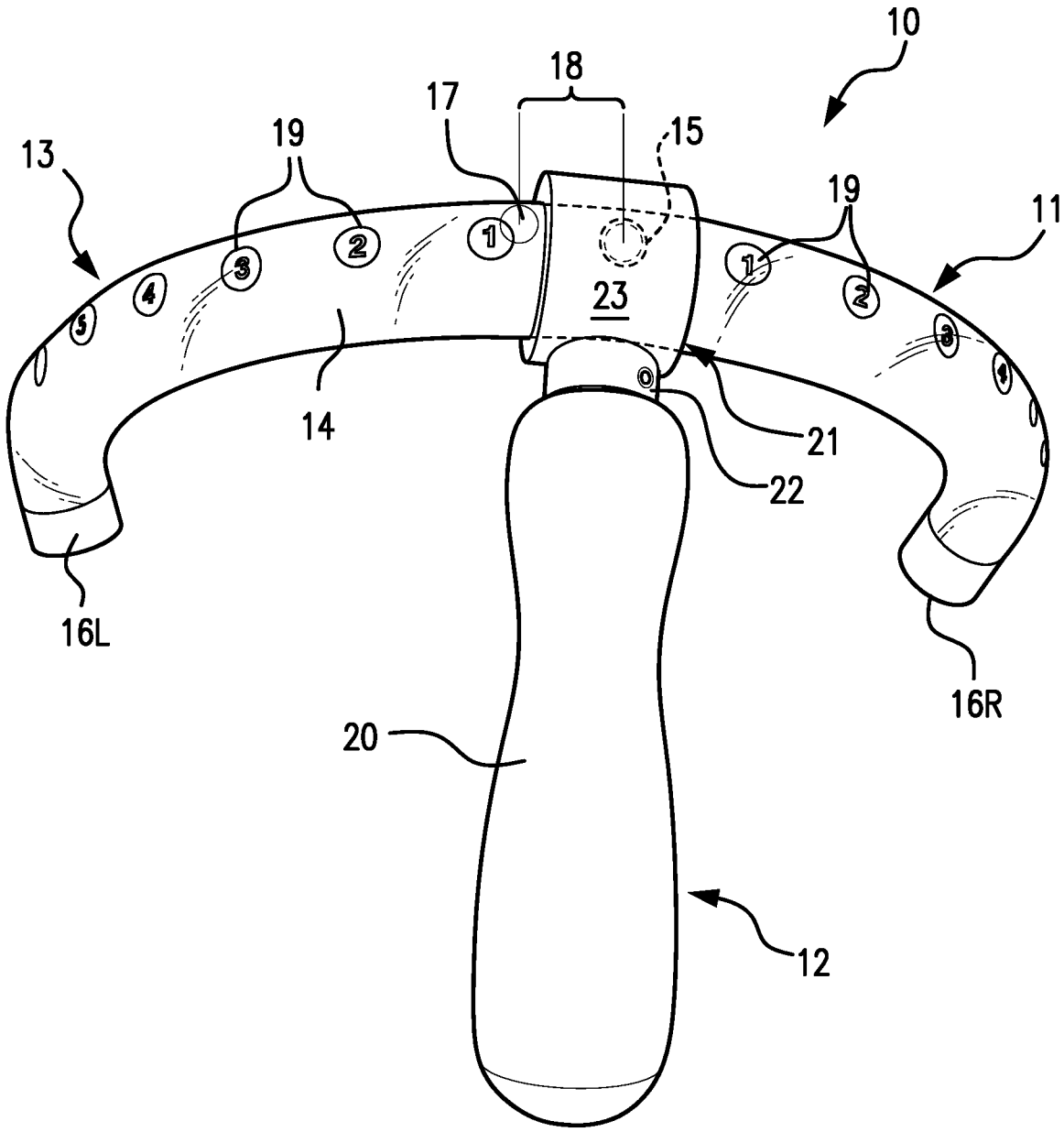
FIG. 1 is a top perspective view of the therapy device according to the preferred embodiment of the present invention.
Figure 2:
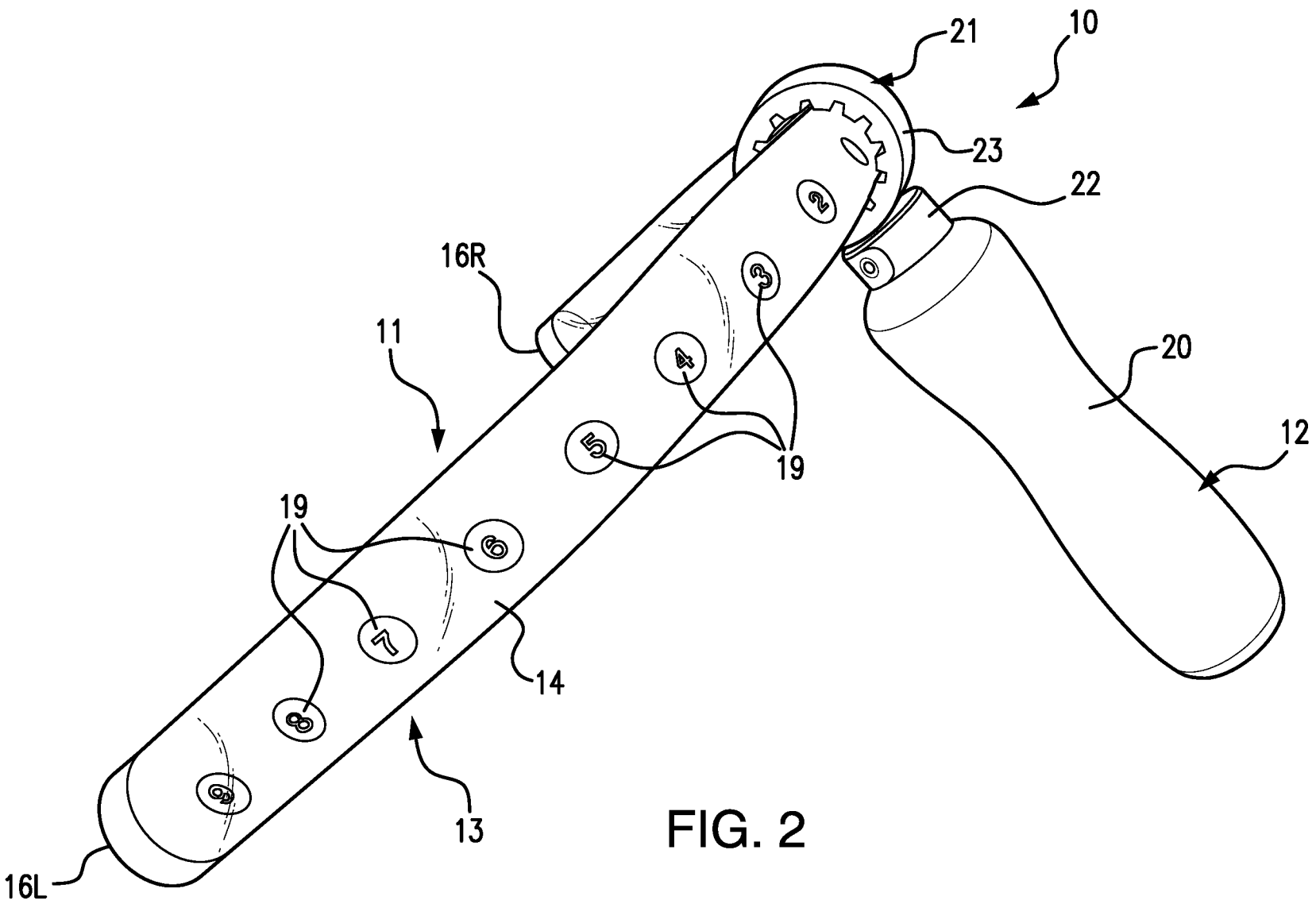
FIG. 2 is a side perspective view of the therapy device according to the preferred embodiment of the present invention.

Referring to FIG. 1 and FIG. 2, the therapy device according to the preferred embodiment of the present invention 10 comprises a deflection tube 11 and a tube handle 12. The deflection tube 11 is rotatably attached to the handle 12, so that the deflection tube 11 can be oriented either perpendicular or parallel to the handle 12. The deflection tube 11 comprise a transparent, semi-circular tube 13, which is filled with a clear liquid 14.

The deflection tube 11 has a tube center 15 and two closed tube ends, namely a tube left end 16L and a tube right end 16R. The clear liquid 14 contains a free-floating, suspended indicator 17, preferably a bubble or a ball. Upon rotation of the deflection tube 11, the suspended indicator 17 moves through a deflection distance 18 from the tube center 15 toward either the tube left end 16L or the tube right end 16R. The semi-circular tube 13 has multiple uniformly-spaced deflection indicia 19, preferably numerals, which mark the deflection distance 18 of the suspended indicator 17 from the tube center 15.

Figure 3C:
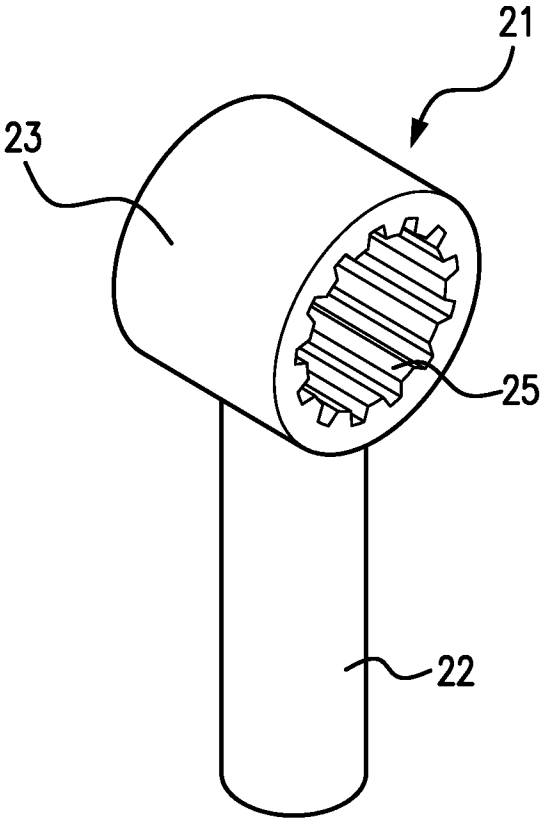
FIG. 3C is a perspective view of the tube fitting member of the tube handle according to the preferred embodiment of the present invention.
Figure 3B:
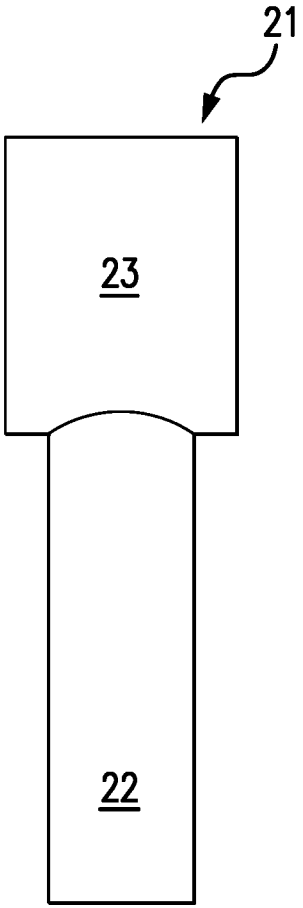
FIG. 3B is a side profile view of the tube fitting member of the tube handle according to the preferred embodiment of the present invention.
Figure 3A:
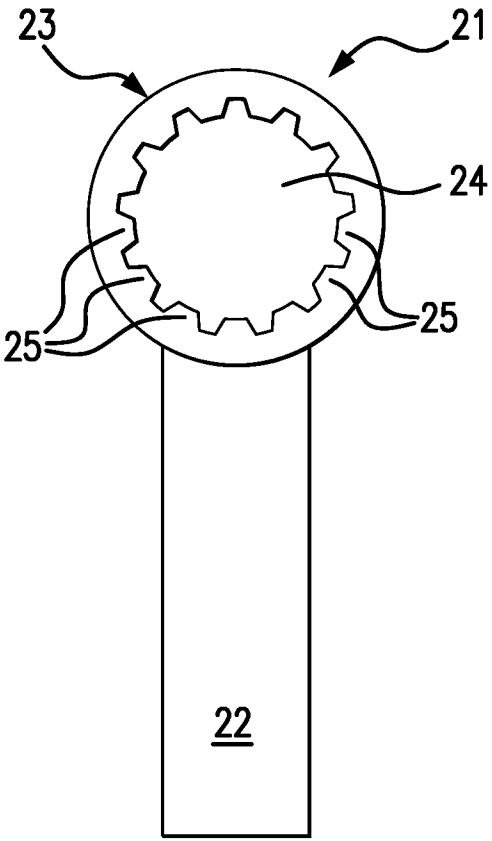
FIG. 3A is a front profile view of the tube fitting member of the tube handle according to the preferred embodiment of the present invention.

The tube handle 12 comprises a grip member 20 and a tube fitting member 21 that is attached to the top of the grip member 20. As shown in FIGS. 3A-3C, the tube fitting member 21 comprises a stem 22 which attaches to the grip member 20. The stem 22 supports a flexible, annular tube holder 23, which has an axial channel 24 that deformably engages and rotatably retains the semi-circular tube 13 at the tube center 15. In the preferred embodiment 10, the axial channel 24 of the tube holder 23 contains multiple flexible longitudinal ribs 25, which deformably engage the semi-circular tube 13 at the tube center 15.

Figure 4:
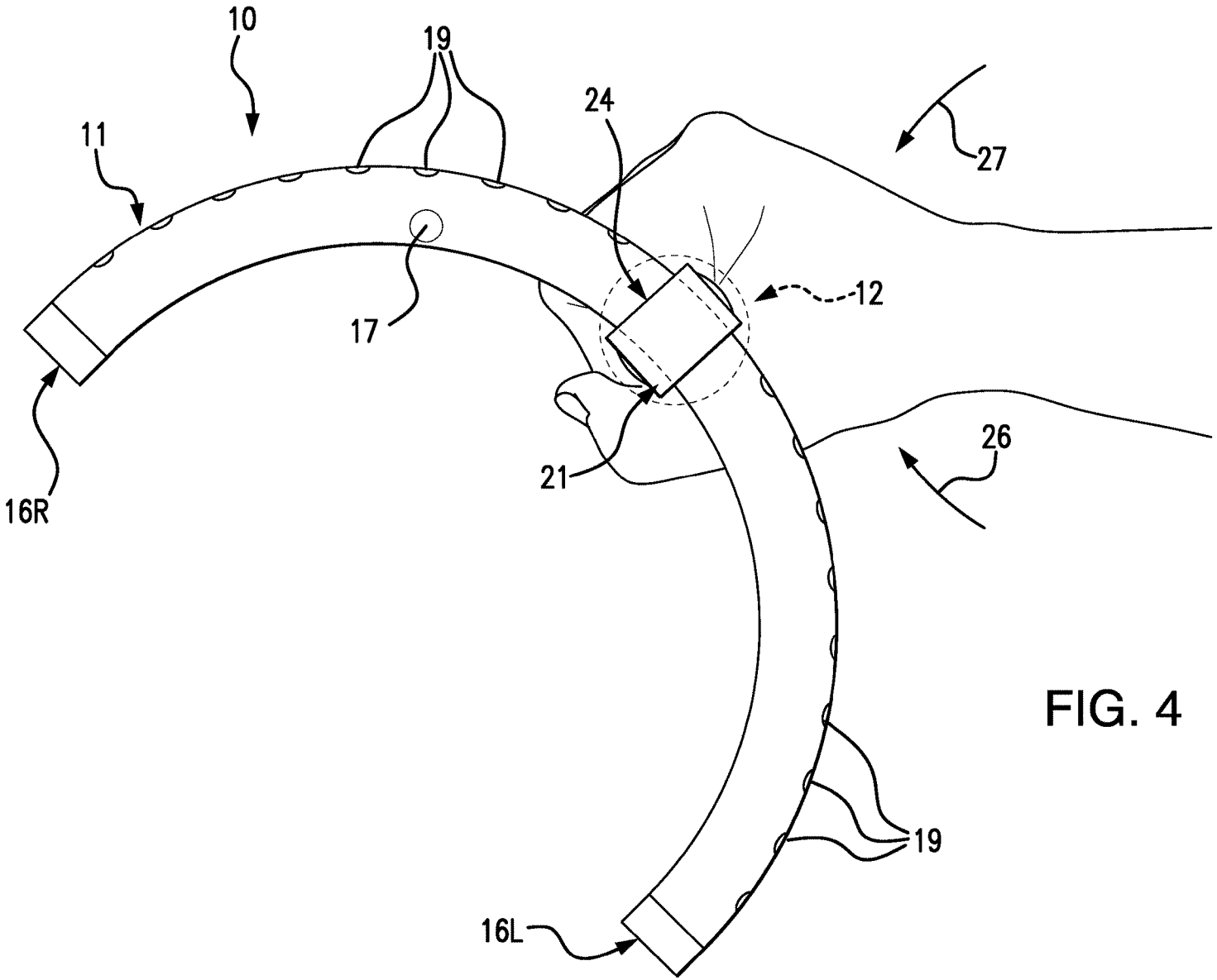
FIG. 4 is a perspective view illustrating the method of using the therapy device for wrist extension and flexion, according to the preferred embodiment of the present invention.
Figure 5:
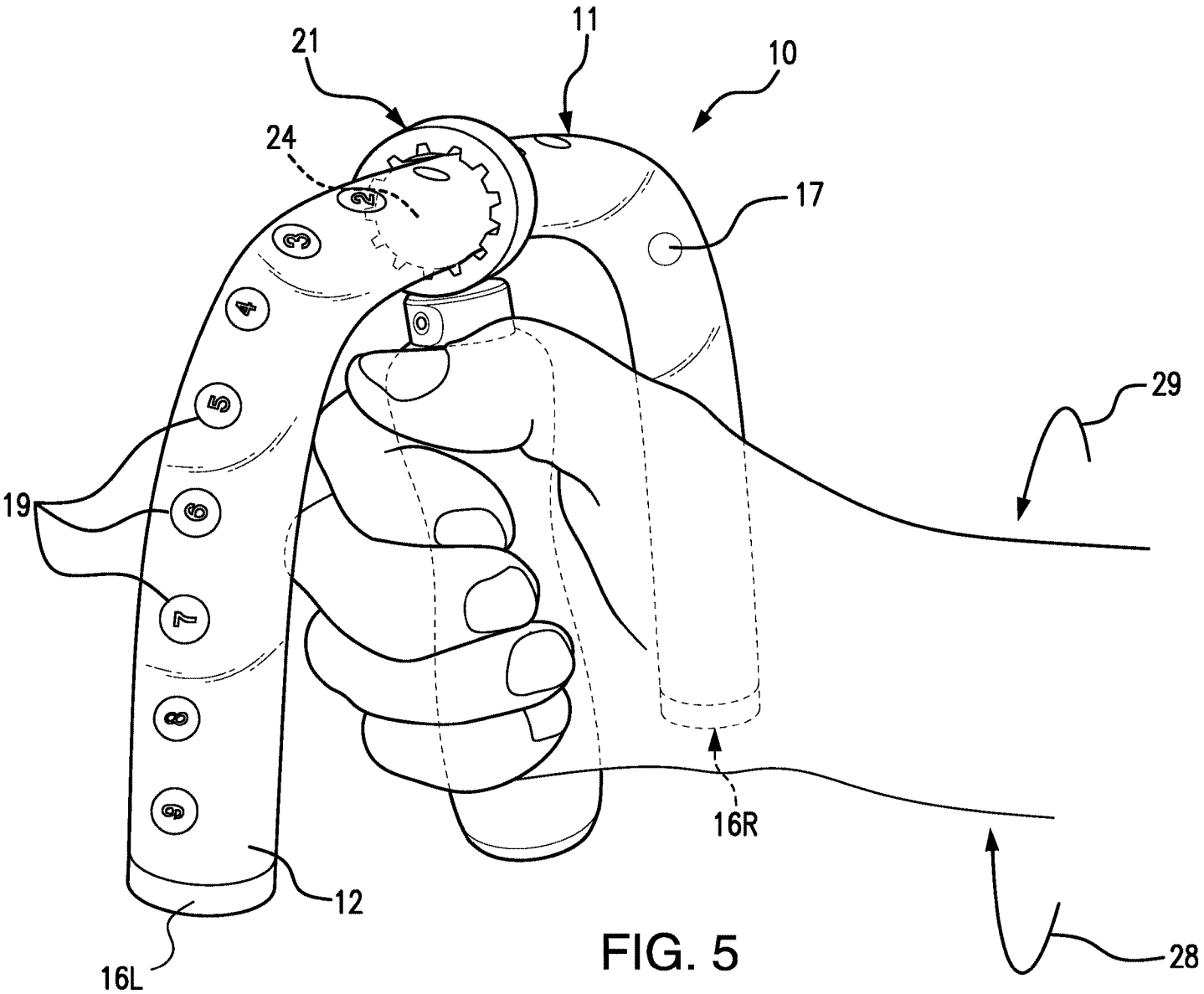
FIG. 5 is a perspective view illustrating the method of using the therapy device for forearm supination and pronation, according to the preferred embodiment of the present invention.

FIG. 4 illustrates the method of using the therapy device 10 in alternating wrist extension 26 and wrist flexion 27 motions. In this mode as shown, the deflection tube 11 has been rotated through the axial channel 24 of the tube fitting member 21 so as to align perpendicular to the handle 12. FIG. 5 illustrates the method of using the therapy device 10 in alternating forearm pronation 29 and supination 28 motions. In this mode as shown, the deflection tube 11 has been rotated through the axial channel 24 of the tube fitting member 21 so as to align parallel to the handle 12.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A therapy device for exercising a user's wrist and forearm, comprising:

a deflection tube and a tube handle, wherein the deflection tube is rotatably attached to the tube handle so that the deflection tube can be oriented either perpendicular or parallel with respect to the tube handle, wherein the deflection tube comprises a transparent, semi-circular tube, and wherein the semi-circular tube is filled with a clear liquid, and wherein the deflection tube has a tube center and two tube ends, which are a tube left end and a tube right end, and wherein the tube left end and the tube right end are both closed or sealed, and wherein the clear liquid contains a suspended indicator which floats freely in the clear liquid and which moves, upon rotation of the deflection tube, through a deflection distance from the tube center towards one of the tube ends, and wherein the semi-circular tube has multiple uniformly-spaced deflection indicia, which mark the deflection distance of the suspended indicator from the tube center; and wherein the tube handle comprises a grip member and tube fitting member, and wherein the tube fitting member comprises a stem which attaches to the grip member and which supports a flexible annular tube holder, having an axial channel which deformably engages and rotatably retains the semi-circular tube at the tube center.

2. The therapy device according to claim 1, wherein the suspended indicator is a bubble or a ball.

3. The therapy device according to claim 1, wherein the deflection indicia comprise numerals that increase from the tube center toward the tube left end and from the tube center toward the tube right end.

4. The therapy device according to claim 2, wherein the deflection indicia comprise numerals that increase from the tube center toward the tube left end and from the tube center toward the tube right end.

5. The therapy device according to claim 1, wherein the axial channel of the annular tube holder contains multiple flexible longitudinal ribs, which deformably engage and rotatably retain the semi-circular tube at the tube center.

6. The therapy device according to claim 2, where in the axial channel of the annular tube holder contains multiple flexible longitudinal ribs, which deformably engage and rotatably retain the semi-circular tube at the tube center.

7. The therapy device according to claim 3, where in the axial channel of the annular tube holder contains multiple flexible longitudinal ribs, which deformably engage and rotatably retain the semi-circular tube at the tube center.

8. The therapy device according to claim 4, where in the axial channel of the annular tube holder contains multiple flexible longitudinal ribs, which deformably engage and rotatably retain the semi-circular tube at the tube center.

9. A therapy method to increase a range of motion of a user's wrist or forearm, comprising the following steps:

(a) providing the therapy device according to any one of claims 1-8;

(b) rotating the deflection tube perpendicular to the tube handle for wrist exercises, or rotating the deflection tube parallel to the tube handle for forearm exercises;

(c) for the wrist exercises, grasping the tube handle generally horizontally and rotating the wrist up and down in wrist extension and flexion motions, or for the forearm exercises, grasping the tube handle generally vertically and rotating the forearm inward and outward in forearm pronation and supination motions;

(d) measuring the range of motion of the user's wrist or forearm based on the deflection distance of the suspended indicator from the tube center; and (e) repeating steps (b)-(d) so as to achieve progressively greater deflection distance of the suspended indicator from the tube center.

* * * * *